US005293882A

United States Patent [19]

Verhappen

[11] Patent Number: 5,293,882

[45] Date of Patent: Mar. 15, 1994

[54] DEVICE FOR UNWINDING A BOBBIN

[75] Inventor: Johannes Verhappen, Veldhoven, Netherlands

[73] Assignee: P.M.B. Patent Machinebouw B.V., Eindhoven, Netherlands

[21] Appl. No.: 996,824

[22] Filed: Dec. 28, 1992

[51] Int. Cl.[5] ..... A24C 1/00

[52] U.S. Cl. ..... 131/105; 242/67.3 R

[58] Field of Search ..... 131/105; 242/67.3 R; 271/307, 312, 213, 216; 414/757

[56] References Cited

U.S. PATENT DOCUMENTS

| | | | |
|---|---|---|---|
| 3,066,881 | 12/1962 | Krueger | 242/67.3 R |
| 3,489,638 | 1/1970 | Collons . | |
| 3,591,044 | 7/1971 | Hooper et al. . | |
| 4,347,856 | 9/1982 | Woltman et al. | 131/105 |
| 4,497,420 | 2/1985 | Stelcher et al. | 242/67.3 R X |
| 4,580,580 | 4/1986 | Kjaer et al. | 131/105 |

FOREIGN PATENT DOCUMENTS

| | | | |
|---|---|---|---|
| 0061814 | 10/1982 | European Pat. Off. . | |
| 404337 | 10/1924 | Fed. Rep. of Germany . | |
| 6707514 | 8/1967 | Netherlands . | |
| 2025752 | 1/1980 | United Kingdom | 131/105 |
| 8103263 | 11/1981 | World Int. Prop. O. . | |

*Primary Examiner*—Vincent Millin
*Assistant Examiner*—Raleigh W. Chiu
*Attorney, Agent, or Firm*—Wegner, Cantor, Mueller & Player

[57] ABSTRACT

A device for detacking leaf material (T), such as tobacco leaf, from bobbin (B), provided with a frame (1), a table (2) with co-acting detacking member connected to the frame, a winding-off reel (3) for the filled belt-shaped carrier, a winding-up reel (20) for the emptied belt-shaped carrier connected to the frame and guide rollers (17, 18, 19) such that the belt is guided stretched over the table, wherein a straight guide edge (8) is placed at a short distance to the front edge (26) of the table in order to form a gap-like space, the winding-off reel is held in or close to a plane which extends perpendicularly of the table and through the guide edge, and one of the guide rollers (17) is arranged on the side of the guide edge remote from the winding-off reel, so that the belt is bent sharply, the tobacco leaf is drawn loose of the belt part and still deposited on the same side of the belt part, whereby any adhesion that may occur is eliminated.

11 Claims, 2 Drawing Sheets

DEVICE FOR UNWINDING A BOBBIN

The invention relates to a device for detacking leaf material, such as tobacco leaf or parts thereof, from a belt-shaped carrier or bobbin, which device is provided with a frame, a table with co-acting detacking member connected to the frame for the purpose of disengaging a sheet of the leaf material from the carrier, a winding-off reel for the filled belt-shaped carrier, a winding-up reel for the emptied belt-shaped carrier connected to the frame and guide rollers which are all placed such that the belt is guided in stepwise manner stretched over the table.

Such a device is used to remove a tobacco leaf or a part thereof in each case from the stretched belt part and to further transport it to a winding nest or the like. During unwinding of the filled bobbin it can occur that the tobacco leaf material, which has already been fixedly clamped between the windings for a considerable time, does not remain on the inside of the belt but remains adhered to the oppositely located outer side of the following belt winding. In order to prevent this it is known to apply a vacuum under the table so that the leaf is drawn fixedly onto the inside of the belt, but such air transport can bring about an excessive drying of the tobacco leaf, which is undesirable.

The invention has for its object to obviate the above stated drawback and provides thereto a device which is distinguished in that a straight guide edge is placed at a short distance, relative to the length thereof, from the front edge of the table to form a gap-like space, the winding-off reel is held in or close to a plane extending perpendicularly of the table and through the guide edge, and one of the guide rollers is arranged on the side of the guide edge remote from the winding-off reel.

Due to the guide edge the belt is now bent sharply as a result of the placing of this guide roller, whereby the tobacco leaf is drawn loose of the belt part and is deposited on the same side of the belt part that is situated on the table, whereby the adhesion which can occur is eliminated.

The guide edge is preferably formed by the edge of a flexible plate which is preferably fixed to the frame with clearance. The flexible plate can therefore tilt and bend slightly, this in the direction towards the bobbin, whereby the belt is bent simultaneously with the release of the bobbin.

It is advantageous to receive the winding-off reel in a sub-frame movable relative to the frame. This movement is preferably performed in the direction of the gap between the guide edge and the front edge of the table, whereby the periphery of the belt-shaped carrier will always be situated at the gap irrespective the diameter thereof.

To avoid too much deformation of the tobacco leaf after it is drawn loose, it is recommended to embody the table with perforations, wherein the table is a wall part of a box connected to a vacuum source. Close to the front edge of the table the perforations are herein embodied as gap-like openings, which gaps extend in the direction of movement of the belt.

Above mentioned and other features will be elucidated further in the figure description hereinbelow of an embodiment. In the drawing.

Figure 1:
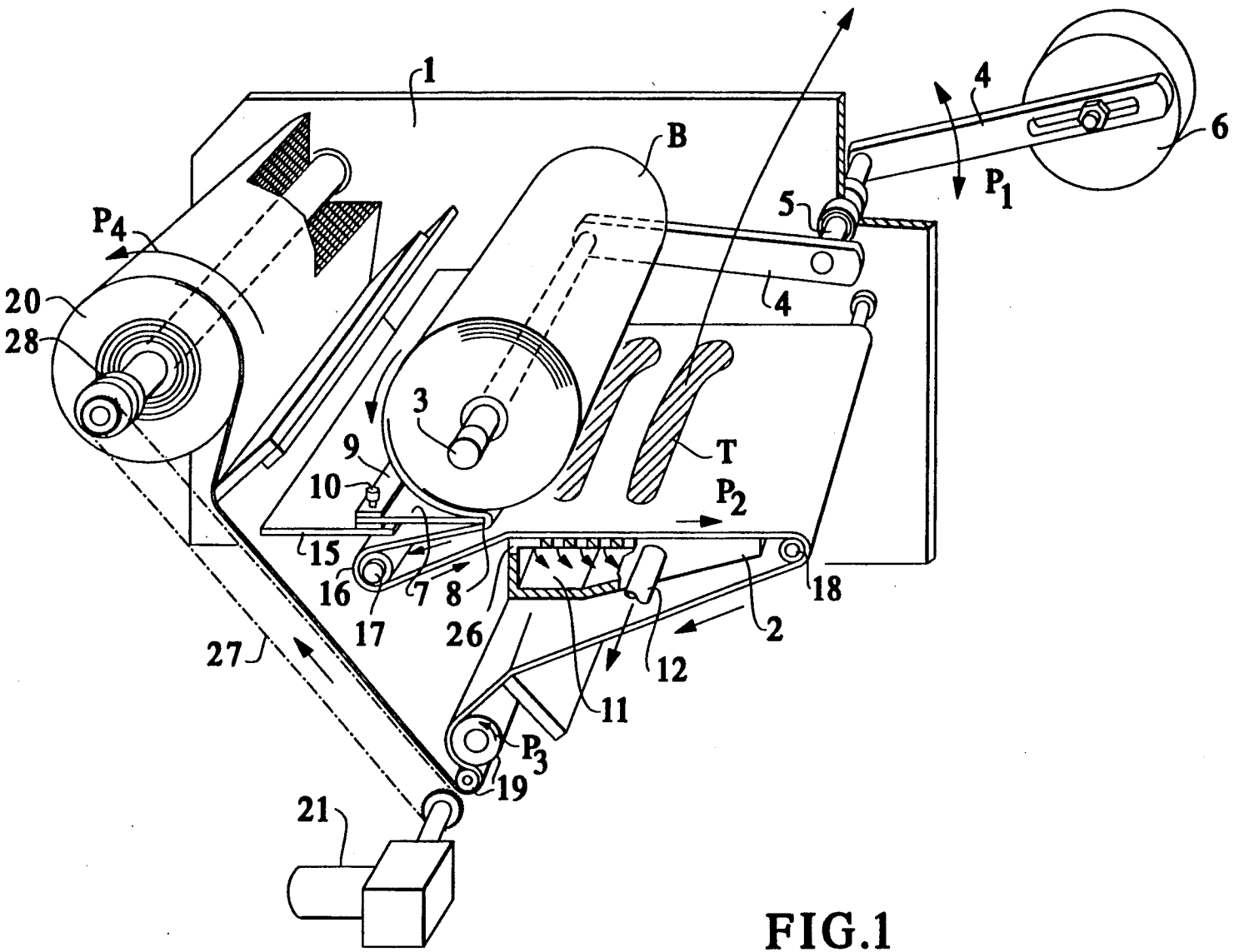
FIG. 1 shows a perspective view of the device according to the invention.

Designated with the numeral 1 is the frame of the device, which frame can be embodied in random manner within the scope of the invention, wherein it can also form part of a larger device, for example a cigar winding machine. As shown here it is a standing plate 1 to the forward side of which is fixed a table 2 such that the top surface thereof extends horizontally or almost horizontally. On the top side of the table 2 is arranged a winding-off reel 3, the shaft of which is fixed to the outer end of a balance arm 4. The balance arm 4 is pivotable up and down around a pin 5 in the direction of the arrow Pl wherein a counter-weight 6 is arranged on the other end of the balance arm 4 to compensate for the weight of the bobbin B arranged on the winding-off reel 3.

Arranged on the front edge 26 of the table 2 is a tiltable and/or flexible plate 7 whereof the guide edge 8 is situated at a short distance from the front edge 26, so that a gap-like space is formed between plate 7 and table 2. The flexible plate 7 is fixedly held with clearance on the side remote from the guide edge in a Unshaped strip 9 which is attached with screw means 10 to a fixed plate 15 which is fixedly welded or attached in other manner to the frame 1. The plate 7 with the guide edge 8 can thereby move up and down to a limited extent in the vertical plane.

Figure 2:
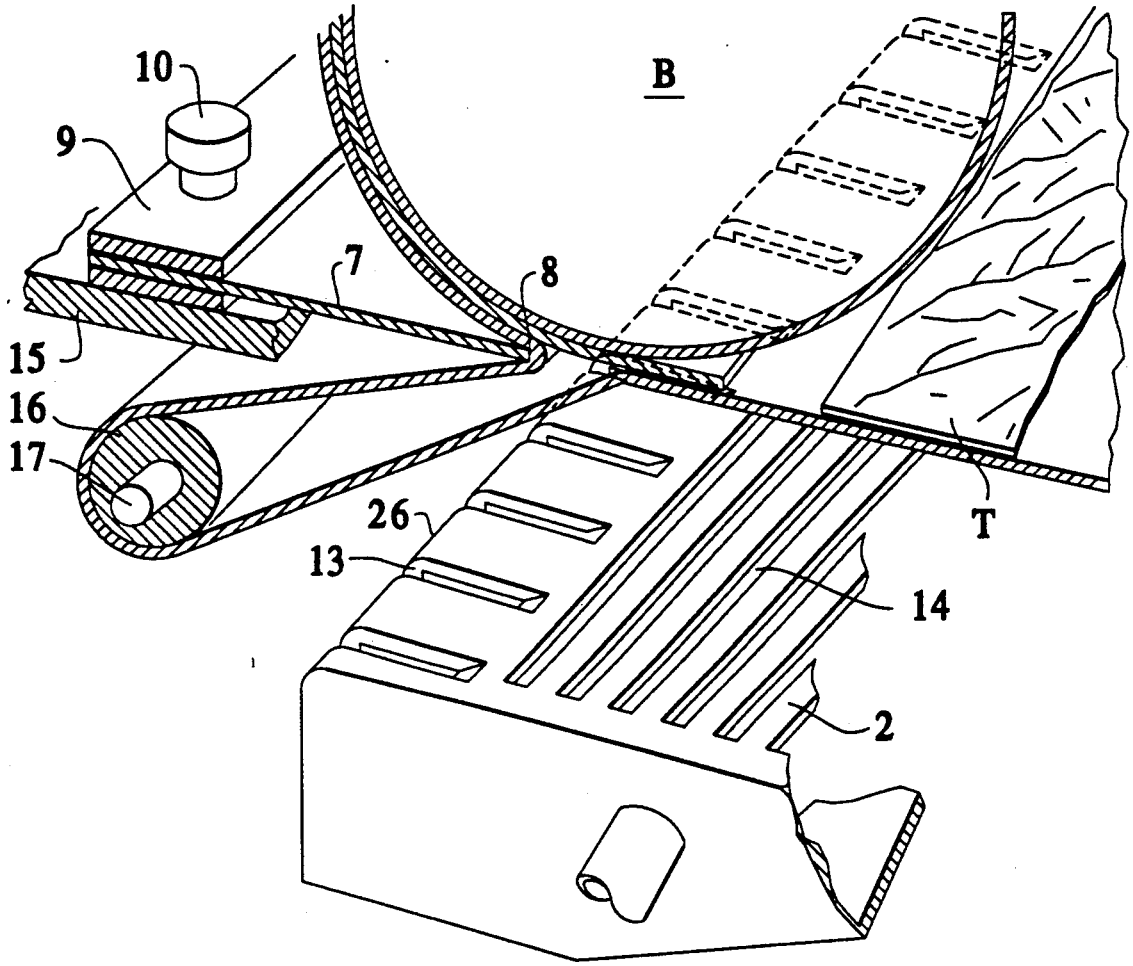
FIG. 2 shows on an enlarged scale a perspective view corresponding with FIG. 1 of a detail of the device.

Arranged on the bottom side of the table 2 is a box 11 which is connected via the stump 12 to a vacuum source (not shown), wherein the table 2 is provided in the manner shown in FIG. 2 with slots 13 and 14 respectively. The slots 13 extend perpendicularly of the front edge 26 in the direction of the movement of the belt for guiding over the table, according to the arrow P2 in FIG. 1. Arranged therebehind are transverse slots 14 which can also be replaced by circular perforations.

On the underside of the flexible plate 7 is arranged ranged a fixed guide roller 16 the rotation shaft 17 of which is situated at just below the clamping strip 9, that is, close to the fixedly clamped side of the flexible plate 7. The rotation shaft 17 is again fixed to the frame plate 1. Arranged behind the table 2 is a second guide roller 18, the rotation shaft of which is likewise fixed to the frame plate 1.

A pair of drive rollers 19 is arranged at a distance below the box 11 wherein the large roller thereof is driven by a motor 21 in the direction of the arrow P3, wherein the motor is designated schematically in FIG. 1, but is supported on the frame 1.

Finally, a winding-up reel 20 is placed in the top left-hand corner of the frame plate 1 to take up the emptied bobbin winding. The winding-up reel 20 is driven in the direction of the arrow P4 by the motor 21 via a chain with slip coupling 27, 28 to enable winding of the belt.

It is further noted that the winding-off reel 3 is braked in a manner not further shown, in order to maintain sufficient belt tension in the belt during the repeated stepwise forward movement by means of the pair of drive rollers 19.

The above described device operates as follows:

When a full bobbin B is placed on the winding-off reel 3, the belt is then trained manually along the guide edge 8, the guide rollers 16, 18, 19 such that the belt can further be wound onto the winding-up reel 20. After energizing of the motor 21 and that of the pair of rollers 19 respectively, the belt can be pulled stepwise from the bobbin B. As a result of the sharp transition at the guide edge 8 of the flexible plate 7 the tobacco leaf material T fixedly clamped on the windings of the bobbin are disengaged from the belt part and deposited through the small gap width directly onto the belt part which is situated at the beginning of the table 2. This transfer is further improved by the vacuum in the box 11 which ensures that air is drawn in via the perforation slots 13 and 14 respectively. This transfer is improved still further due to the lengthwise slots 13.

With the embodiment shown the sharp bending of the belt part is furthered by the balance arm 4, which ensures that under a light pressure the bobbin B rests respectively on the front edge 26 of the table and the guide edge 8 of the plate 7. As a result of the belt tension the plate 7 will be tilted or bent slightly in upward sense, this against the underside of the bobbin B, which ensures that the leaf material, in particular tobacco leaf material, is drawn loose immediately and transferred onto the belt part at the beginning of the table.

It is finally noted that the weight that must be compensated can be adjusted simply by moving the position of the counter-weight 6 relative to the balance arm 4 until the desired pressure of the bobbin is reached close to the gap at the beginning of the table 2.

The invention is not limited to the above described embodiment. The roller 1 does not for instance have to lie close beneath the fixing strip 9 and flexible plate 7 respectively but can also occupy another position depending on the desired bending of the bobbin material. Nor does the surface of the table 2 have to extend in horizontal sense but may also occupy a sloping position depending on the construction of the desired detacking device for detacking the leaf parts T, which is assumed to be known and is therefore not reproduced in the figure. The plate 7 can also be fixedly clamped and effect an up and downward movement of front edge 8 through its own flexibility.

The driving of the belt of the winding B can also take place in a manner other than that described and shown.

I claim:

1. In a device for disengaging sheets of leaf material from a belt-shaped carrier, said device having a frame having a winding-off reel and a winding-up reel operatively associated therewith, a table with co-acting means, connected to said frame, for disengaging said sheets from said carrier, said disengaging means having said winding-off reel supporting a coil of said carrier having said sheets held between windings of said coil, said winding-up reel supporting an empty portion of said carrier from which said sheets have been disengaged, and guide rollers situated such that said carrier is guided while stretched over said table, the improvement comprising:

a straight guide edge situated a short distance, relative to a length of said guide edge, from a front edge of said table so as to define a gap between said guide edge and said front edge;

means for holding said winding-off reel with a rotational axis thereof parallel to said guide edge;

one of said guide rollers being arranged on an opposite side of said guide edge from said winding-off reel, and said guide edge being part of a plate attached to said frame by means for providing that said edge is movable toward and away from said coil.

2. In a device for disengaging sheets of leaf material from a belt-shaped carrier, said device having a frame having a winding-off reel and a winding-up reel operatively associated therewith, a table with co-acting means, connected to said frame, for disengaging said sheets from said carrier, said disengaging means having said winding-off reel supporting a coil of said carrier having said sheets held between windings of said coil, said winding-up reel supporting an empty portion of said carrier from which said sheets have been disengaged, and guide rollers situated such that said carrier is guided while stretched over said table, the improvement comprising:

a straight guide edge situated a short distance, relative to a length of said guide edge, from a front edge of said table so as to define a gap between said guide edge and said front edge;

means for holding said winding-off reel with a rotational axis thereof parallel to said guide edge;

one of said guide rollers being arranged on an opposite side of said guide edge from said winding-off reel, and a subframe movable relative to said frame and in which said winding-off reel is receivable, such that said winding-off reel is movable toward and away from said gap.

3. The improvement as in claim 2, and said subframe comprising:

a balance arm having a counterweight and being rotatable relative to said frame.

4. In a device for disengaging sheets of leaf material from a belt-shaped carrier, said device having a frame having a winding-off reel and a winding-up reel operatively associated therewith, a table with co-acting means, connected to said frame, for disengaging said sheets from said carrier, said disengaging means having said winding-off reel supporting a coil of said carrier, with said sheets being held between windings of said coil, said winding-up reel supporting an empty portion of said carrier from which said sheets have been removed, and guide rollers situated such that said carrier is guided while stretched over said table, the improvement comprising:

a straight guide edge situated a short distance, relative to a length of said guide edge, from a front edge of said table so as to define a gap between said guide edge and said front edge, means for holding a rotational axis of said winding-off reel parallel to said guide edge;

one of said guide rollers being arranged on an opposite side of said guide edge from said winding-off reel;

means for improving disengagement of said sheets from a next winding of said coil during uncovering of said next winding by an outer winding of said coil, said disengagement improving means comprising:

means for holding said coil adjacent said guide edge at said gap such that said carrier is redirected by said guide edge at a line of uncovering of said outer winding from said next winding in order to insure disengagement of said sheets from said outer and next windings at said guide edge.

5. The improvement as in claim 4, and further comprising:

said guide edge being part of a plate and being movable toward said coil during said uncovering in order to insure that said disengagement is immediate.

6. The improvement as in claim 5, and further comprising:

means for attaching said plate to said frame such that said plate is tiltable in order that said carrier acts to move said guide edge toward said coil.

7. The improvement as in claim 5, and further comprising:

said plate being flexible in order that said carrier acts to move said guide edge toward said coil.

8. The improvement as in claim 4, and further comprising:

said table having perforations on which a vacuum is pulled to hold said sheets thereto during transporting of said sheets away from said gap.

9. The improvement as in claim 8, and further comprising:

some of said perforations being slots extending from said front edge in a direction of said transporting.

10. The improvement as in claim 4, and further comprising:

a subframe on which said winding-off reel is received, said subframe being movable toward said gap in order to maintain said outer winding adjacent said guide edge at said gap during said unwinding of said coil.

11. The improvement as in claim 10, and said subframe comprising:

a pivotal balance arm providing support for said winding-off reel at one end thereof and being counter balanced at another end thereof.

* * * * *